United States Patent [19]

McClure et al.

[11] Patent Number: 4,564,195

[45] Date of Patent: Jan. 14, 1986

[54] TENNIS BALL SUPPORT DEVICE

[76] Inventors: Robert H. McClure, 101 Farber Rd. A4, Princeton, N.J. 08540; Robert W. Peach, 888 Pine Trail, Arnold, Md. 21012; John R. Peach, 3606 Moss Side Ave., Richmond, Va. 23222

[21] Appl. No.: 620,282

[22] Filed: Jun. 13, 1984

[51] Int. Cl.[4] ..... A63B 69/38

[52] U.S. Cl. ..... 273/29 A; 273/26 R

[58] Field of Search ..... 273/26 D, 26 R, 29 A, 273/412, 365, 359, 144 A, 144 B; 244/119; 446/34, 176, 178, 179; 124/56, 64

[56] References Cited

U.S. PATENT DOCUMENTS

| | | | |
|---|---|---|---|
| 2,100,690 | 11/1937 | Andler | 446/179 |
| 2,111,326 | 3/1938 | Norris | 244/119 |
| 3,297,324 | 1/1967 | Evans | 273/397 |
| 3,722,888 | 3/1973 | Ducharme | 273/126 R |

*Primary Examiner*—Richard C. Pinkham
*Assistant Examiner*—T. Brown
*Attorney, Agent, or Firm*—Sperry, Zoda & Kane

[57] ABSTRACT

A tennis ball support device is disclosed which is adapted to hold a tennis ball in mid-air without any contact thereof by the blowing of air from underneath. This device includes a housing having side walls being generally cylindrical and a top and bottom. A blower is positioned securely with respect to a mounting platform generally centrally within the housing and the housing defines apertures for receiving and expelling air therefrom. An outlet controlling device is affixed to the upper end of the housing within the outlet aperture to control the distance and speed of upwardly moving air used to support a tennis ball. The devices within the support device are resiliently mounted or insulated with respect to one another such as to minimize sound transmission between parts of the support device to provide a quietly functioning design. Also insulation is used throughout the chamber defined within the housing to further minimize noise and vibration. The height of the ball can be controlled by movement of the outlet control device or a change of shape or design thereof.

16 Claims, 3 Drawing Figures

TENNIS BALL SUPPORT DEVICE

BACKGROUND OF THE INVENTION

1. Field Of The Invention

The present device is useful for the teaching of tennis to beginners and for improving the strokes of more advanced players. There is a need to position a tennis ball at a suitable fixed height and location so that a player may swing at a ball unobstructed by any support just as if he were hitting a tennis ball which has been struck and directed toward him by an opponent. However it is not desirable to have the ball directed anywhere specifically but it would be at a fixed location so that the player can practice whatever proper strokes he desires and a coach can correct a stroke without requiring any additional persons or machines for directing a ball toward the practicing player.

2. Description Of The Prior Art

Many patents have been designed for practicing of sports or other games such as U.S. Pat. Nos. 137,119 issued March 25, 1873 to W. Withers; 834,707 issued Oct. 30, 1906 to C. Bradshaw et al; 1,744,680 issued Jan. 21, 1930 to R. Sherrill; 1,816,521 issued July 28, 1931 to J. Feeley; 2,055,498 issued Sept. 29, 1936 to H. Jacobs; 2,100,690 issued Nov. 30, 1937 to R. Andler; 2,272,765 issued Feb. 10, 1942 to J. Beeson et al; 2,911,745 issued Nov. 10, 1959 to V. Simon; 2,903,817 issued Sept. 15, 1959 to W. McLain et al; 3,325,935 issued June 20, 1967 to D. Holter; 3,465,471 issued Sept. 9, 1969 to S. Friedman; 3,876,203 issued Apr. 8, 1975 to P. Gold; 3,887,182 issued June 3, 1975 to J. Breslow and 3,940,132 issued Feb. 24, 1976 to J. Lopatto.

None of these patents show the specific design for a tennis ball support device wherein the ball is not contacted by any external elements other than merely air.

SUMMARY OF THE INVENTION

This invention provides a tennis ball support device which includes a housing which can have a cylindrical wall means as well as a top and bottom means. These members define a generally cylindrically shaped chamber means therein defining at least one and preferably four inlet apertures to readily allow the flow of air from the external surrounding environment into the chamber. Furthermore the top means of the housing defines an outlet aperture to readily allow the flow of air outwardly from the chamber means.

An outlet control device is included positioned adjacent to the outlet aperture to control the direction and flow of air therethrough. Also a mounting platform is located within the chamber and extends across the chamber to be in contact with the cylindrical interior walls in such a fashion as to divide the chamber into two zones. One of these zones will be in fluid flow communication with respect to the outlet aperture and will be defined as the outlet zone and the other will be in fluid flow communication with respect to the inlet aperture and that will be defined as the inlet zone. The mounting platform itself prevents fluid flow communication between the two platforms but it does include a mounting aperture therein in which is mounted a blower. The only means of fluid flow communication between the inlet zone and the outlet zone is through the blower. For this purpose the blower includes an air intake positioned within the inlet zone and an air exhaust positioned within the outlet zone. The blower means would then be operable to draw air through the air intake means and blow air out through the air exhaust means which will ultimately be exhausted through the outlet aperture and the outlet control means to hold the tennis ball supported thereabove.

To facilitate securement of the mounting platform with respect to the other apparatus at least one mounting strut can be positioned extending longitudinally upward from the bottom means to abut the under surface of the mounting platform and support it extending in its horizontal orientation. Also brackets can be affixed to the walls of the housing to present upwardly facing shoulders for supporting the mounting platform.

Such blowers are inherently quite loud and as a result it is preferable in the present invention to include a sound insulation material extending across the inner surfaces of the wall means as well as the top and bottom means to absorb blower noise. Furthermore to minimize blower noise elements of the construction herein will be mounted with respect to other elements generally by resilient material. In particular a resilient insulating means will extend across the upper ends of the mounting strut in such a manner as to minimize sound transmission therebetween. Furthermore resilient first securement means will be positioned at the outer periphery of the mounting platform for securing same resiliently with respect to the wall to minimize sound transmission. Also a resilient second securement means will mount the blower means resiliently with respect to the mounting platform to further minimize noise transmission. These members may preferably be of resilient material such as rubber washers.

The outlet control device preferably includes a release nozzle which defines a tapered release bore therethrough. The small end of the release bore is upwardly facing and allows the air to be expelled at a high speed therefrom for supporting a tennis ball at a specific location. This release nozzle is movable with respect to the housing and is selectively affixed at particular locations by release of a locking means. This locking means holds the release nozzle at any desired position with respect to the top means of the housing.

Preferably the sound insulation will include orifices therein directly adjacent to the inlet apertures and the outlet apertures to facilitate fluid flow therethrough.

It is an object of the present invention to provide a tennis ball support device wherein no portion of the device itself contacts the ball when in the suspended position.

It is an object of the present invention to provide a tennis ball support device wherein the vertical height of the tennis ball can be varied as desired.

It is an object of the present invention to provide a tennis ball support device which is of relatively low cost.

It is an object of the present invention to provide a tennis ball support device which is easily maintained.

It is an object of the present invention to provide a tennis ball support device which is extremely quiet in operation.

It is an object of the present invention to provide a tennis ball support device which includes relatively little vibration.

It is an object of the present invention to provide a tennis ball support device which includes a tapered air outlet control device for varying the air released thereby for holding of the tennis ball in the supported position.

It is an object of the present invention to provide a tennis ball support device which releases a column of ball-supporting air directed normal to the ground.

It is an object of the present invention to provide a tennis ball support device which defines an air tight interior chamber divided into an inlet zone and an exhaust zone.

It is an object of the present invention to provide a tennis ball support device which minimizes metal to metal contact within the unit.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

BRIEF DESCRIPTION OF THE PREFERRED EMBODIMENT

Figure 1:
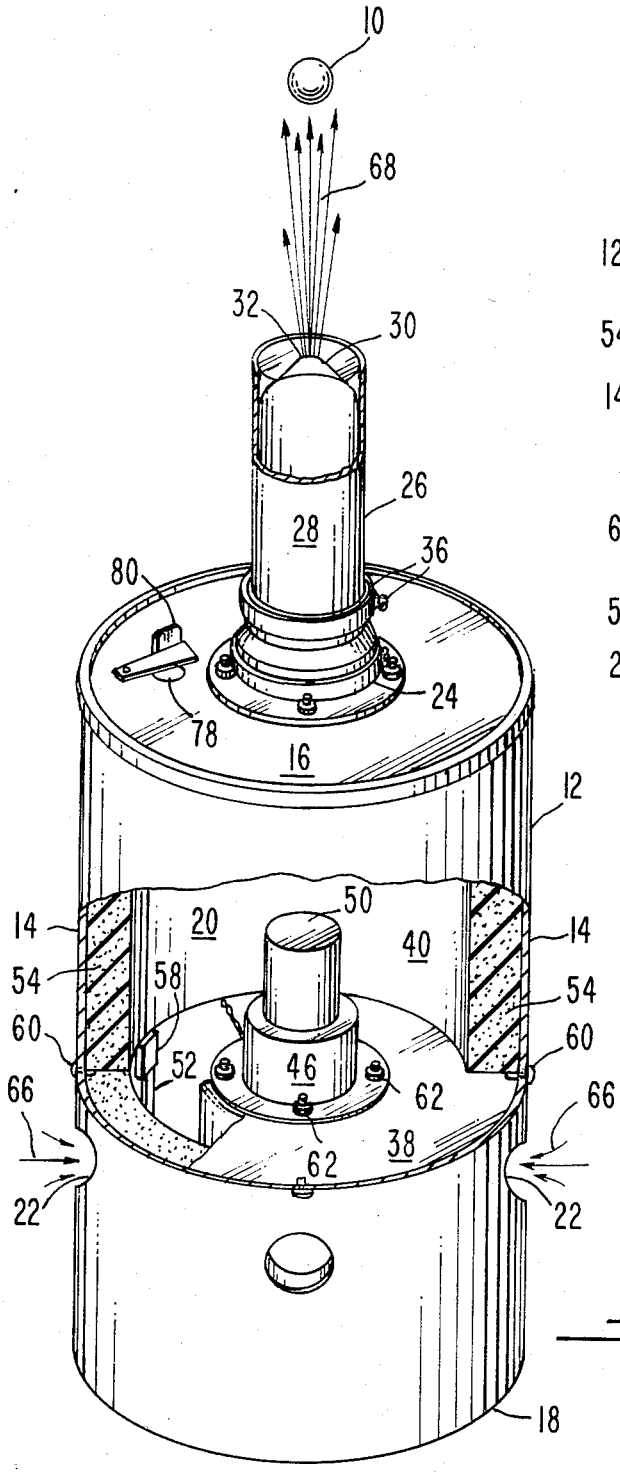
FIG. 1 is a front perspective view of an embodiment of the tennis ball support device of the present invention.

The present invention provides a novel tennis ball support device as best shown in FIG. 1 which has the capability of supporting a tennis ball 10 at an elevated position thereabove by the movement of a column of exhausting air 68. This column of air will support the tennis ball such that it can be struck for practicing a tennis stroke.

Figure 2:
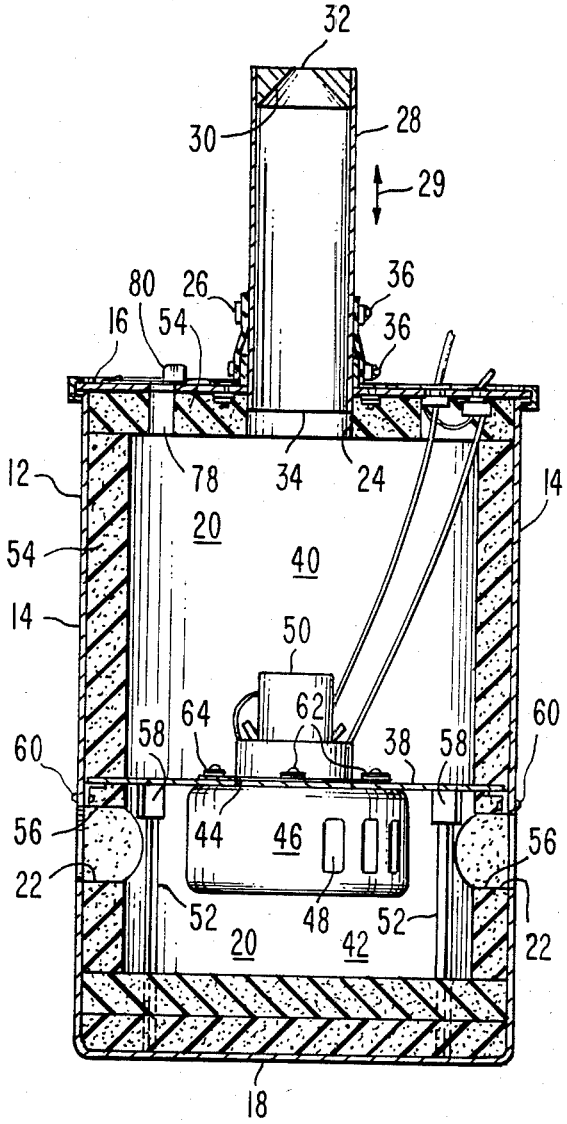
FIG. 2 is a front cross-sectional view of an embodiment of the tennis ball support device of the present invention.

The support device itself includes a housing 12 which is formed by a generally cylindrical wall means 14. A horizontally extending top means 16 and bottom means 18 close the upper and lower portions, respectively, of wall means 14 in such a manner as to form a chamber means 20 therein. Air is introduced into the chamber means through at least one inlet aperture 22 or as shown in FIGS. 1 and 2 four such inlet apertures 22. Air is exhausted through an outlet aperture 24.

A mounting platform 38 extends horizontally within the chamber means 20 at any pre-chosen position therein. This mounting platform includes a mounting aperture 44 therein in which is positioned a blower means 46. The mounting platform 38 generally divides the chamber 20 into an outlet zone 40 and an inlet zone 42. Outlet zone 40 is in fluid flow communication with respect to outlet aperture 24 and similarly inlet zone 42 is in fluid flow communication with respect to inlet apertures 22.

The blower means 46 defines air intake means 48 therein and air exhaust means 50 therein. The air intake means 48 is positioned within the inlet zone 42 and the air exhaust means 50 is positioned within the outlet zone 40. In this manner when operated the blower means 46 will draw air from inlet zone 42 and expel it through the outlet zone 40 and thereby through the outlet aperture 24. When the air passes through outlet 24 it is controlled in its direction and velocity of movement by an outlet control means 26. This outlet control means preferably takes the form of a release nozzle 28 positioned within outlet aperture 24. Release nozzle 28 defines a release bore 30 extending longitudinally therethrough which is preferably tapered with the smaller end 32 thereof adjacent to the external environment and the larger end 34 thereof adjacent to the housing 12. In this manner the velocity of air will be increased as it is exhausted through the nozzle 24. Also release nozzle 28 is movably positioned with respect to the outlet aperture 24 and can be moved in an upward and downward direction as shown by arrow 29 in FIG. 2. As the release nozzle 20 is moved up and down the position of the ball 10 will move up and down correspondingly and once the desired final orientation is attained then a releasable locking means 36 will be locked and thereby fix the position of the outlet control means 26 with respect to the housing 12.

Figure 3:
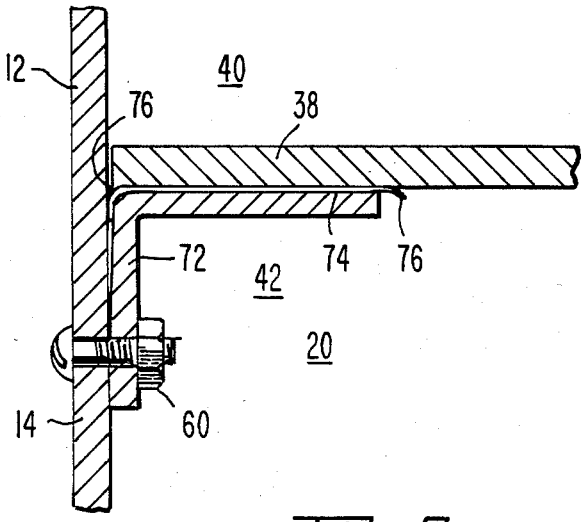
FIG. 3 is a view of an embodiment of the bracket which can be used for supporting of the mounting platform of the present invention.

To facilitate maintaining of the mounting platform 38 in the horizontally extending position a plurality of mounting strut means 52 may extend from bottom means 18 upwardly into contact with the lower surface of mounting platform 38. These mounting strut means 52 will support the weight of the blower and of the mounting platform 38. A resilient first securement means 60 can also be positioned about the outer edge of the mounting platform 38. This securement means should be mounted with respect to the housing and may take the form of a bracket means 72 secured by a screw or the like as shown in FIG. 3 with respect to the housing. Bracket 72 can present an upwardly facing shoulder means 74 which is covered with a resilient member 76. Member 76 is preferably of a rubber type material such that when the mounting platform 38 is placed thereon transmission of vibrations between housing 12 and mounting platform 38 will be minimized.

To further minimize the noise of this tennis ball support device during operation a sound insulation means 54 will preferably extend about the inner portion of wall means 14 and of top means 15 and of bottom means 18. To facilitate the flow of air from the external environment into the inlet zone 42 through inlet aperture 22 a plurality of insulation orifices 56 will be positioned in registration with respect to inlet aperture 22.

To minimize the transmission of vibrations or sound of the blower from the mounting platform to the mounting strut means 52 a resilient insulating means 58 as shown best in FIG. 2 will be positioned extending across the upper portion of the mounting strut 52 to minimize any direct material contact other than through the resilient grommet. To further minimize the noise or vibration transmission a resilient second securement means 62 which may take the form of a rubber washer 64 will separate the blower means 46 itself with respect to the mounting platform 38.

In operation of this invention the blower means will be rendered operational causing entering 66 to be drawn inwardly into the inlet zone 42 through inlet aperture 22. This moving air will then be drawn through air intake means 48 of blower means 46 and expelled through air exhaust means 50 thereof. This air will then pass through the outlet zone 40 and the outlet aperture 24. This moving air will then travel through the orifice into release bore 30 thereby to be released in an upwardly directed manner as exhausting air 68. A tennis ball can then be supported thereabove at a pre-chosen position depending on the speed of operation of the blower and upon the chosen position for the release nozzle 28.

Support mounting platform 38 can be achieved by mounting strut means 52 or by bracket means 72. It is not necessary that both devices be utilized. However both devices could be utilized to assure firm support thereof.

The housing means can also define a vent means 78 such as an aperture anywhere in fluid flow communication with the outlet zone 40. This vent means should be variable in size such as to selectively release varying amounts of exhausting air. In this manner the amount of air actually being expelled upwardly to support the tennis ball can be further controlled. Preferably the means for controlling the size of the vent means 78 can be a simple movable tab means 80 as shown in FIG. 1 which can be moved across the vent means to completely block same or can be moved away from the vent means to completely open same or can be placed at any intermediate position. In this manner the size of the vent means can be controlled from a cross-sectional area of zero to the maximum cross-sectional area.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

We claim:

1. A tennis ball support device comprising:

(a) a housing including a wall, top and bottom with said top extending across the top of said wall to define a chamber therein, said housing defining at least one inlet aperture therein to readily allow flow of air from the external environment into said chamber, said housing defining an outlet aperture to readily allow flow of air outwardly from said chamber;

(b) an outlet control positioned adjacent to said outlet aperture to control the flow of air therethrough, said outlet control comprising a release nozzle which defines a release bore therethrough which air is forced to support a tennis ball thereabove, said release nozzle being movable in and out with respect to said housing and said chamber means;

(c) a mounting platform positioned extending across said chamber to divide same into two sections, said chamber now including an outlet zone in fluid flow communication with respect to said outlet aperture and an inlet zone in fluid flow communication with communication between said inlet zone and said outlet zone, said mounting platform defining a mounting aperture therein;

(d) a blower mounted securely with respect to said mounting platform in a position extending through said mounting aperture, said blower including an air intake positioned within said inlet zone and an air outlet exhaust positioned within said outlet zone, said blower being operable to draw in air through said intake and blow air out through said air exhaust; and (e) a mounting attached with respect to said mounting platform for holding same in position extending in a horizontal orientation.

2. The device as defined in claim 1 wherein said inlet aperture is defined in said wall of said housing.

3. The device as defined in claim 2 wherein said wall defines four inlet apertures.

4. The device as defined in claim 3 comprising sound insulation which includes insulation orifices adjacent to said inlet apertures and said outlet aperture to allow fluid flow therethrough.

5. The device as defined in claim 1 wherein said outlet aperture is defined in said top of said housing.

6. The device as defined in claim 1 further including sound insulation extending across the inner surfaces of said wall, and top and said bottom to reduce the sound of operation of said blower.

7. The device as defined in claim 1 including a resilient first securement means located at the outer periphery of said mounting platform and securing same resiliently with respect to said wall to minimize sound transmission therebetween.

8. The device as defined in claim 1 further including a resilient second securement means securing said blower with respect to said mounting platform to minimize sound transmission therebetween.

9. The device as defined in claim 8 wherein said resilient second securement means includes rubber washers.

10. The device as defined in claim 1 wherein said release bore is of a tapered configuration with the smaller aperture facing outwardly with respect to said chamber.

11. The device as defined in claim 1 further including a releasable locking means for selectively holding said release nozzle with respect to said top of said housing.

12. The device as defined in claim 1 wherein said housing is cylindrical.

13. The device as defined in claim 1 where said mounting comprises a mounting strut extending longitudinally upward from said bottom to abut and support said mounting platform.

14. The device as defined in claim 13 further including a resilient insulating means extending across the upper ends of said mounting strut to minimize sound transmission from said mounting platform to said mounting strut.

15. The device as defined in claim 1 wherein said mounting comprises a bracket secured with respect to said housing and defining a shoulder extending inwardly with respect to said chamber under said mounting platform for supporting same.

16. A tennis ball support device comprising:

(a) a housing including a wall, top and bottom with said top extending across the top of said wall to define a chamber therein, said wall defining at least four inlet apertures therein to readily allow flow of air from the external environment into said chamber, said top defining an outlet aperture to readily allow flow of air outwardly from said chamber;

(b) an outlet control positioned adjacent to said outlet aperture to control the flow of air therethrough, said outlet control including a release nozzle defining a release bore therethrough through which air is forced to support a tennis ball in position thereabove, said release bore being of a tapered configuration with the smaller end facing outwardly with respect to said chamber, said release nozzle being movable in and out with respect to said housing and said chamber, said outlet control further including a releasable locking means for selectively holding said release nozzle with respect to the top of said housing;

(c) a mounting platform positioned extending horizontally across said chamber to divide same into two sections, said chamber now including an oulet zone in fluid flow communication with respect to said outlet aperture and an inlet zone in fluid flow communication with respect to said outlet aperture and an inlet zone in fluid flow communication with respect to said inlet aperture, said mounting platform preventing fluid flow communication between said inlet zone and said outlet zone, said mounting platform defining a mounting aperture therein;

(d) a blower mounted securely with respect to said mounting platform in a position extending through said mounting aperture, said blower including an air intake positioned within said inlet zone and an air exhaust positioned within said outlet zone, said blower being operable to draw air through said air intake and blow air out through said air exhaust;

(e) mounting strut extending longitudinally upward from said bottom to abut and support said mounting platform in position extending in a horizontal orientation;

(f) sound insulation extending across the inner surfaces of said wall, said top and said bottom to reduce the sound of operation of said blower, said sound insulation defining insulation orifices adjacent to said inlet apertures and said outlet apertures to allow fluid flow therethrough;

(g) resilient insulation extending across the uppoer ends of said mounting strut to minimize sound transmission from said mounting platform to said mounting strut;

(h) resilient first securement means located at the outer circumference of said mounting platform and securing same resiliently with respect to said wall to minimize sound transmission therebetween; and (i) a resilient second securement means fixedly securing said blower with respect to said mounting platform to minimize sound transmission therebetween, said resilient second securement means including rubber washers to further minimize same sound transmission.

* * * * *